US006364441B1

(12) United States Patent
Arnold

(10) Patent No.: US 6,364,441 B1
(45) Date of Patent: Apr. 2, 2002

(54) TOE KICK DRAWER

(76) Inventor: David M. Arnold, 404 Oak St., Auburndale, FL (US) 33823

( * ) Notice: Subject to any disclaimer, the term of this patent is extended or adjusted under 35 U.S.C. 154(b) by 0 days.

(21) Appl. No.: 09/617,035

(22) Filed: Jul. 14, 2000

Related U.S. Application Data

(60) Provisional application No. 60/144,872, filed on Jul. 20, 1999.

(51) Int. Cl.[7] ..... A47B 88/04

(52) U.S. Cl. ..... 312/319.1; 312/228

(58) Field of Search ..... 312/278, 279, 312/330.1, 334.7, 204, 228, 229, 319.1, 326, 228.1, 235.1

(56) References Cited

U.S. PATENT DOCUMENTS

| | | | | | |
|---|---|---|---|---|---|
| 1,849,809 | A | * | 3/1932 | Showers | 312/319.1 X |
| 2,320,556 | A | | 6/1943 | Belshaw | |
| 2,333,717 | A | * | 11/1943 | Heed et al. | 312/278 X |
| 2,723,894 | A | | 11/1955 | Bartleson | 312/210 |
| 2,778,034 | A | * | 1/1957 | Smith | 312/228 X |
| 5,277,487 | A | | 1/1994 | Simon | 312/278 |
| D343,746 | S | | 2/1994 | Simon | D6/491 |
| 5,549,375 | A | * | 8/1996 | Pagliaccio | 312/319.1 |
| 5,647,687 | A | | 7/1997 | Robinson et al. | 403/403 |
| D385,483 | S | | 10/1997 | Robinson et al. | D8/382 |
| 5,706,678 | A | * | 1/1998 | Sasaki | 312/228 X |
| 5,718,495 | A | * | 2/1998 | Lee | 312/319.1 |
| 5,755,498 | A | | 5/1998 | Cutler | 312/235.1 |
| 5,857,757 | A | * | 1/1999 | Bieker et al. | 312/902 X |

FOREIGN PATENT DOCUMENTS

| | | |
|---|---|---|
| GB | 579071 | 7/1941 |
| GB | 631146 | 10/1949 |
| GB | 1095497 | 12/1967 |

* cited by examiner

*Primary Examiner*—James O. Hansen
(74) *Attorney, Agent, or Firm*—Richard C. Litman

(57) ABSTRACT

A toe kick drawer and method which includes installation of a first and second track for insertably connecting a drawer. Each track is attached to an inner wall portion located within a cavity, enclosed by the toe kick plate or portion of a cabinet. The drawer also includes a spring-loaded mechanism for selectively opening, closing and/or securing the drawer respectively. A rolling disc is attached to a number of drawers at a first and second location for dynamic movement of a respective drawer through each respective track. The toe kick drawer is particularly shaped and configured to fit a geometry defined by a preexisting clearance or cavity covered or enclosed by a toe kick plate. The drawer and track or guide assembly are shaped and formed from a number of durable materials. A preferred method of making and installing the drawer includes the use of cleats to provide opening clearances for bathroom or kitchen cabinets.

8 Claims, 3 Drawing Sheets

TOE KICK DRAWER

CROSS-REFERENCE TO RELATED APPLICATION

This application claims the benefit of U.S. Provisional Patent Application Ser. No. 60/144,872, filed Jul. 20, 1999.

BACKGROUND OF THE INVENTION

1. Field of the Invention

The present invention relates generally to cabinets. More specifically, the invention is a toe kick drawer and method which maximize usable or wasted storage space in a variety of cabinet structures, without destroying the structure or aesthetic value of an existing cabinet or cabinet system.

2. Description of Related Art

A variety of cabinet fixtures have been devised for bathroom vanity and kitchen cabinets to say the least. However, vanity devices heretofore devised and utilized are known to be made up of well known structural configurations, notwithstanding the myriad for fulfilling numerous objectives and requirements. A toe kick drawer and method which maximize existing storage space and minimize extensive bending and reaching for a user as herein described is lacking and not disclosed in the related art, as represented by the following patents.

For example, U.S. Pat. No. 2,320,556 issued to Belshaw discloses a display storage case for fresh fruits and vegetables. The main structural features of the storage case are directed to the base strut having a facing and a rear strut or toe kick panel which are secured between spaced vertical panels. Drawers are placed above the toe kick panels, which teaches away from the toe kick drawer and method as herein described.

U.S. Pat. No. 2,723,894 issued to Bartleson discloses a kitchen sink cabinet comprising a hidden box like compartment mounted in and around the plumbing of the sink as an interior or nested drawer compartment. Drawer activation or opening and closing of the compartment requires extensive bending and reaching by the user as a non-toe-kick compartment.

U.S. Pat. No. 5,277,487 issued to Simon discloses a conventional toe kick drawer which requires extensive cuts or modifications to an existing cabinet structure for accommodating a drawer above the toe kick panel or plate. The toe kick drawer and method as herein described requires only the removal of the toe kick plate for adapting a mechanized drawer thereto. A spring loaded mechanism is also provided to minimize physical labor required for opening and closing conventional toe kick drawers.

U.S. Pat. No. 5,755,498 issued to Cutler discloses a similar pullout compartment to that taught by Simon, except that the compartment is a sliding vanity step system for a bathroom vanity wherein a child or like person stands thereon as a height adjustment platform.

U.S. Pat. No. 5,647,687 issued to Robinson et al. discloses a toe kick end cap for cabinets. A pair of end cap connectors serve to connect a vertical toe kick plate between the spaced vertical side walls of a kitchen base cabinet. Each end cap connector includes a body portion adapted to abut the front edge of the associated side panel, a first flange portion extending orthogonally from the body portion to engage the corresponding inner surface of the associated side wall, and an abutment surface interconnected with the toe kick plate.

U.S. Design Patents issued to Simon U.S. Pat. No. Design 343,746 and Robinson et al. U.S. Pat. No. Design 385,483 illustrate conventional toe kick design features for toe kick related plates and vanity cabinets. Robinson et al., for example, illustrates a substantially rectangular toe kick base which is attached and assembled to form a stair-step configuration.

Foreign Patents issued to Earle (GB 579,071), Owen et al. (631,146) and Turtkovic (1,095,497) disclose conventional cabinet and drawer features which are of general significance to the kick toe drawer and method as herein described.

None of the above inventions and patents, taken either singly or in combination, is seen to describe the instant invention as claimed.

SUMMARY OF THE INVENTION

The toe kick drawer and method according to the invention includes a first and second track for insertably connecting a drawer therethrough. Each track is fixedly attached to an inner wall portion located within a cavity enclosed by the toe kick plate or portion of a cabinet. The drawer also includes at least one spring-loaded mechanism for selectively opening, closing and/or securing the drawer respectively. A rolling disc is attached to the drawer at a first and second location for dynamic movement of the drawer through each track. The toe kick drawer is particularly shaped and configured to the geometry defined by a preexisting clearance or cavity covered by the toe kick plate.

The drawer and track or guide assembly are shaped and formed from a number of durable materials. A preferred method of making and installing the drawer is described, and includes exemplary applications for bathroom or kitchen cabinets. In addition, cleats are installed to provide opening clearances for a variety of cabinets.

Accordingly, it is a principal object of the invention to provide a toe kick drawer which maximizes existing storage space and minimizes extensive bending and pulling by the user.

It is another object of the invention to provide a toe kick drawer which is primarily activated by the foot of a user.

It is a further object of the invention to provide a toe kick drawer which is simple to install and use.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is directed to a toe kick drawer and method for installing the toe kick drawer within the toe kick area of a variety of cabinet systems. The preferred embodiments of the present invention are depicted in FIGS. 1–3, and are generally referenced by numeral 4.

Figure 1:
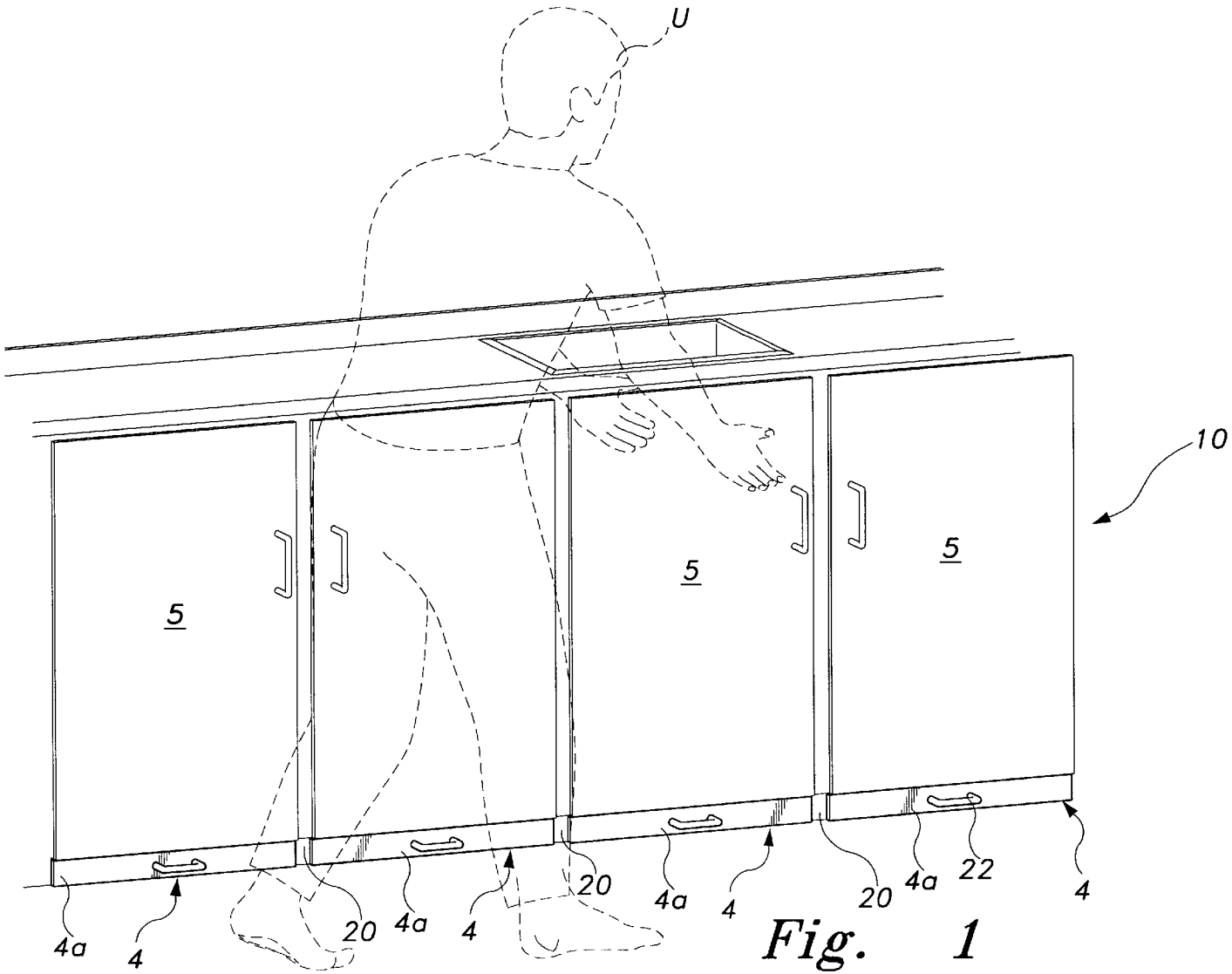
FIG. 1 is an environmental, perspective view of a toe kick drawer according to the present invention.

A perspective view of the toe kick drawer 4 is shown in combination with a cabinet 10 in FIG. 1. The cabinet 10 includes at least one front cabinet door 5 with the toe kick drawer 4 disposed directly beneath the cabinet door 5. The front door 5 opens to expose a cabinet enclosure having a base B, as best seen in FIG. 3. The toe kick drawer 4 includes a front panel 4*a* that has dimensions substantially equal to those of a conventional kick plate (not shown). The toe kick drawer 4 occupies an area beneath the base B of cabinet 10 designated herein as toe kick area A, as best shown in FIG. 2. The toe kick area 4 is conventionally defined as that area beneath the base of the enclosure of a cabinet and the floor or supporting surface. This area is normally closed off by a front kick plate and is generally regarded as wasted space of a cabinet structure. Toe kick area A measures about 2½ inches to 3½ inches in height and has a depth substantially equal to that of the cabinet enclosure. A ½ inch cleat can be added to the floor of a toe kick area of a particular cabinet structure to allow for an opening clearance.

Figure 2:
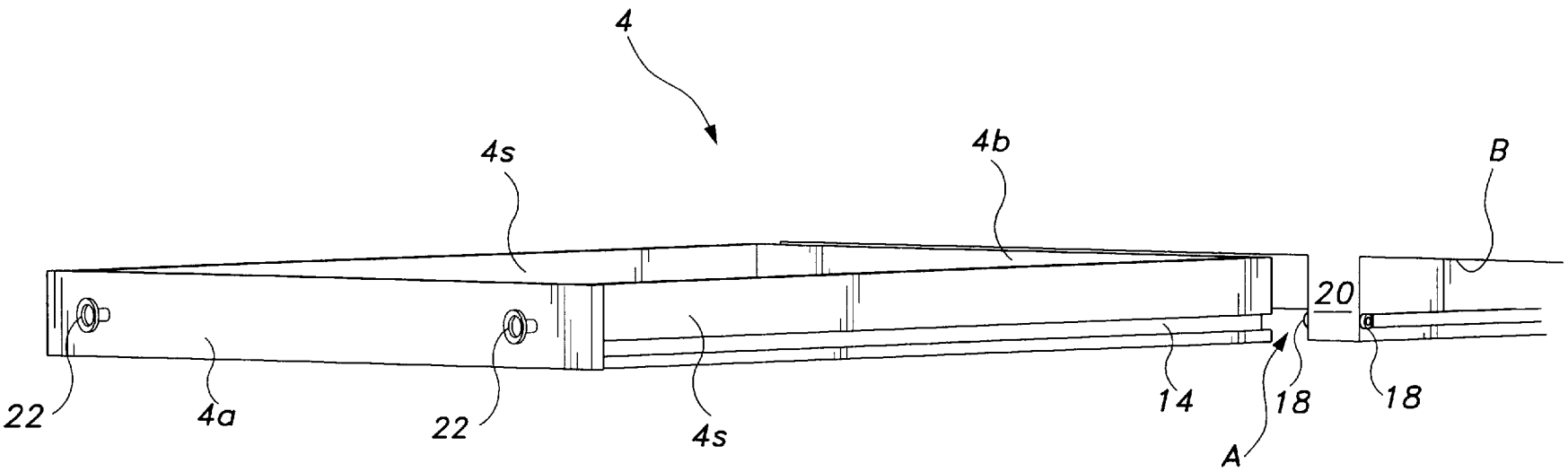
FIG. 2 is a perspective side view of the toe kick drawer according to the invention.
Figure 3:
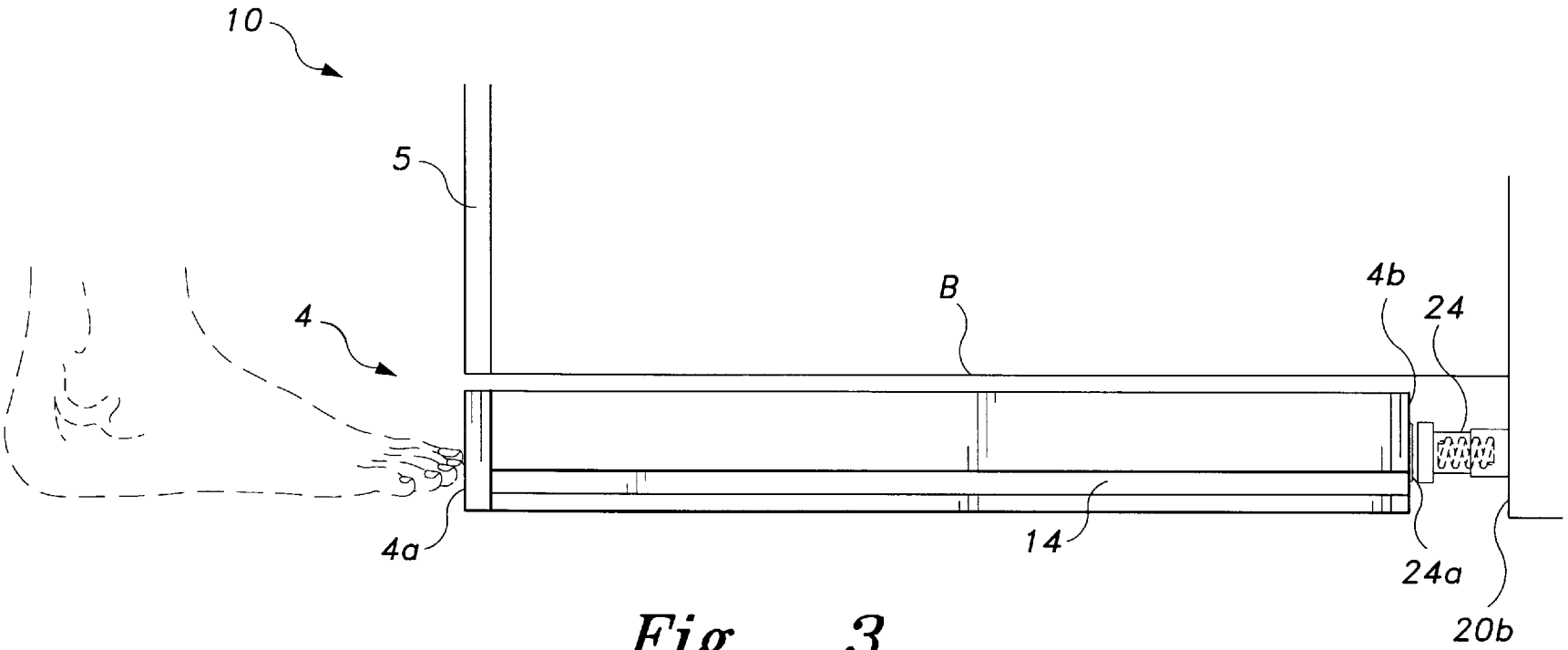
FIG. 3 is a perspective side view of the toe kick drawer according to the invention, illustrating the attachment of a spring loaded mechanism for foot activation.

As best seen in FIG. 2, each toe kick drawer 4 further includes side walls 4*s* and a back wall 4*b*. The toe kick drawer 4 is slidably mounted within toe kick area A which is bounded on opposing sides by a lateral wall 20 extending downward from base B of the cabinet 10. The height of wall 20 is substantially equal to the height of front panel 4*a*. Each side wall 4*s* of drawer 4 has a track 14 exteriorly attached thereto which cooperates with a respective rolling disc 18 attached interiorly to each wall lateral 20 for insertably supporting the drawer 4 within toe kick area A.

Preferably, the exterior surface of each front panel 4*a* has at least one handle 22 disposed thereon to facilitate in opening and closing the toe kick drawer 4. As diagrammatically illustrated in FIGS. 1 and 2, a variety of ornamental handles 22 can be used so long as they can be easily manipulated by the toe or foot of a user U. The drawer 4 can be made of any durable, water resistant material such as laminated woods, composite plastics or metal such as stainless steel or similar metallic materials.

As shown in FIG. 3, the present invention preferably includes a spring-loaded magnetic mechanism 24 and a mating metal plate 24*a* to further facilitate in selectively opening and closing the toe kick drawer 4, as well as securing it in a closed position. The spring-loaded magnetic mechanism 24 is attached to the rear cabinet wall 20*b* which extends beneath base B of cabinet 10 into toe kick area A, and the mating metal plate 24*a* is attached to the back wall 4*b* of the toe kick drawer 4. This mechanism allows the toe kick drawer 4 to be released from a closed or secured position to an open position, wherein it projects forward with only a slight pressure on front panel 4*a*. In the closed position, front panel 4*a* is substantially coplanar with front door 5 when closed, as shown in FIGS. 1 and 3.

The toe kick drawer 4 according to the present invention may be conveniently installed in a variety of existing cabinet structures by simple removing the conventional kick plate to expose the toe kick area, forming at least one toe kick drawer dimensioned and configured to fit within the toe kick area and mounting the toe kick drawer to the cabinet structure by rolling means for sliding the drawer in and out of the toe kick area. At least one spring loaded latch mechanism as described above may be coupled to the cabinet structure such that the toe kick drawer can be slidably opened and closed with relative ease. Alternatively, toe kick drawer 4 of the present invention may be incorporated into a variety of cabinet systems at the time of manufacture. Thus, the present invention makes use of space normally wasted in conventional cabinet assemblies to provide cabinets with slidable toe kick drawers for the accessible storage of a variety of items. The present toe kick drawer is preferably used with kitchen cabinets and bathroom vanities, but may find application with other such furniture structures.

It is to be understood that the present invention is not limited to the embodiments described above, but encompasses any and all embodiments within the scope of the following claims.

I claim:

1. A furniture cabinet comprising:

a furniture cabinet structure including at least one front cabinet door openable to define an enclosure having a base, said cabinet structure including opposing lateral walls, each of the lateral walls extending downward from said base to define a toe kick area, said cabinet structure further including a rear wall extending downward from said base into the toe kick area, said rear wall having a spring-loaded magnetic mechanism attached thereto; and at least one toe kick drawer mounted beneath the base of said cabinet structure, said at least one toe kick drawer including a front panel, opposing side walls and a back wall, wherein a mating metal plate is attached to the back wall of said at least one toe kick drawer for selectively moving said at least one toe kick drawer between a closed position and an open position, said toe kick drawer being slidably movable between the closed position and the open position such that when in the closed position, the at least one toe kick drawer is secured and occupies the toe kick area while the front panel is substantially coplanar with the front cabinet door when closed.

2. The cabinet according to claim 1, wherein each of the opposing side walls of said at least one toe kick drawer includes a track exteriorly attached thereto, and each of the lateral walls includes a cooperating rolling disc attached interiorly thereto for slidably mounting the at least one toe kick drawer within the toe kick area.

3. The cabinet according to claim 1, wherein the toe kick area measures about 2½ to 3⅓ inches in height and has a depth substantially equal to that of the cabinet enclosure.

4. The cabinet according to claim 1, wherein the front panel of said at least one drawer includes at least one handle exteriorly attached thereto.

5. The cabinet according to claim 1, wherein said furniture cabinet structure is selected from the group consisting of a bathroom vanity and kitchen cabinet.

6. A method of modifying an existing cabinet structure to make use of wasted space, said method comprising the steps of:

providing a furniture cabinet structure defining a cabinet enclosure having a base, the cabinet structure including a front kick plate, a rear wall and opposing lateral walls, the rear wall and each of the lateral walls extending downward from the base to define a toe kick area;

removing the toe kick plate to expose the toe kick area;

forming a toe kick drawer dimensioned and configured to fit within the toe kick area, the drawer having a front panel, opposing side walls and a back wall; and mounting the toe kick drawer to the cabinet structure beneath the base of the cabinet enclosure by rolling means for sliding the drawer in and out of the toe kick area.

7. The method according to claim 6, wherein the mounting step includes attaching a track to each of the opposing side walls of the toe kick drawer and attaching a cooperating roller disc to each of the lateral walls for slidably mounting the toe kick drawer within toe kick area.

8. The method according to claim 6, further comprising the step of attaching a spring-loaded magnetic mechanism to the rear wall of the cabinet structure, and attaching a mating metal plate to the back wall of the toe kick drawer for selectively opening and securing the toe kick drawer.

* * * * *